US008640997B1

(12) United States Patent
Caskey

(10) Patent No.: US 8,640,997 B1
(45) Date of Patent: Feb. 4, 2014

(54) SENSOR HARNESS CLAMP FOR CONTINUOUS CASTING SENSORS

(76) Inventor: Robert Caskey, Yelm, WA (US)

( * ) Notice: Subject to any disclaimer, the term of this patent is extended or adjusted under 35 U.S.C. 154(b) by 532 days.

(21) Appl. No.: 12/924,436

(22) Filed: Sep. 28, 2010

(51) Int. Cl.

| | |
|---|---|
| ***F16L 3/08*** | (2006.01) |
| ***F16L 5/00*** | (2006.01) |
| ***F16L 3/12*** | (2006.01) |
| ***F16L 9/00*** | (2006.01) |
| ***F16L 11/00*** | (2006.01) |

(52) U.S. Cl.
USPC ..... 248/65; 248/68.1; 248/58; 248/74.3; 138/163; 138/167; 138/118; 138/118.1

(58) Field of Classification Search
USPC ..... 248/65, 68.1, 58, 74.3; 138/163, 167, 138/118, 118.1
See application file for complete search history.

(56) References Cited

U.S. PATENT DOCUMENTS

| | | | | |
|---|---|---|---|---|
| 2,896,009 | A * | 7/1959 | Caveney | 174/72 A |
| 3,080,892 | A * | 3/1963 | Plummer | 138/128 |
| 3,814,835 | A * | 6/1974 | Merry | 174/70 R |
| 4,494,594 | A | 1/1985 | Kurzinski | |
| 4,899,965 | A * | 2/1990 | Usui | 248/68.1 |
| 4,905,943 | A * | 3/1990 | Sugiyama | 248/68.1 |
| 4,929,478 | A * | 5/1990 | Conaghan et al. | 428/35.1 |
| 5,260,678 | A * | 11/1993 | Van Wagener et al. | 336/96 |
| 5,350,316 | A * | 9/1994 | Van Wagener et al. | 439/460 |
| 5,535,787 | A * | 7/1996 | Howell | 138/167 |
| 5,597,980 | A * | 1/1997 | Weber | 174/72 A |
| 5,901,756 | A * | 5/1999 | Goodrich | 138/167 |
| 6,610,929 | B1 * | 8/2003 | Motokawa | 174/72 A |
| 6,627,483 | B2 | 9/2003 | Ondricek et al. | |
| 6,655,643 | B1 * | 12/2003 | Hoyl et al. | 248/68.1 |
| 6,900,385 | B1 * | 5/2005 | Hsu | 174/36 |
| 7,157,801 | B2 | 1/2007 | Verhaegen | |
| 7,628,178 | B2 * | 12/2009 | Ackermann et al. | 138/110 |
| 2007/0181336 | A1 | 8/2007 | Lipp et al. | |
| 2009/0107450 | A1 | 4/2009 | Olsen et al. | |

* cited by examiner

*Primary Examiner* — Terrell McKinnon
*Assistant Examiner* — Christopher Garft
(74) *Attorney, Agent, or Firm* — Harpman & Harpman

(57) ABSTRACT

A harness clamp to hold, position and mount multiple thermocouple wire sensors in a continuous casting mold tube. The harness clamp has longitudinally spaced wire sensor openings with multiple apertured mounting tabs extending from a in use folded wire chase enclosure body member portion with overlying engagement retainment flanges to secure the wire retainment flange portion over the wire sensors positioned therewithin.

5 Claims, 4 Drawing Sheets

SENSOR HARNESS CLAMP FOR CONTINUOUS CASTING SENSORS

BACKGROUND OF THE INVENTION

1. Technical Field

This invention relates to the use of temperature sensors to sense the change in temperature in a mold tube of a continuous casting application as the thermal energy is removed by cooling in the water jacket. Specifically, the mounting of multiple sensors in the mold tube and protecting them from water coolant flow and volume required.

2. Description of Prior Art

Prior art devices of this type are unknown; with the current industrial use relying on a variety of make do attachment applications.

Such current use requires the application of stainless steel clad thermo sensors mounted in apertures in the mold tubes and held in place with epoxy sealants to form a water-tight seal and prevent dislodgement during operation in which cooling water is circulated about the mold tube within the fixture under high velocity to achieve the proper thermal conditions required during continuous casting.

Prior art search failed to locate any specific devices with the closest connected towards sensor retainment art in somewhat unrelated fields, see U.S. Pat. Nos. 7,157,801, 6,627,483 on thermal sensing and mounting on electrical components respectively and U.S. Publication 2007/0181336 and 2009/0107450 on automotive wiring harness and fuel line protective covers. Prior art definition directed to cooling systems for continuous steel casting machines to delineate the nature of the problem can be seen in U.S. Pat. No. 4,494,594 illustrating cooling water system needed in such continuous casting venues.

SUMMARY OF THE INVENTION

A thermocouple sensor array retainment and mounting clamp to hold and protect multiple thermocouple sensors positioned within a mold tube of a continuous casting application to monitor "cast" forming temperatures within the mold as it cools. The sensor wire harness clamp has multiple spaced sensor access apertures with an elongated deformable projection flange secured over the sensor wires by multiple retainment tabs. Mounting slots are from in the clamp to afford direct fastener attachment to the surface of the mold tube adjacent the point of access and insertion of multiple sensor wires.

DETAILED DESCRIPTION OF THE INVENTION

Figure 1:
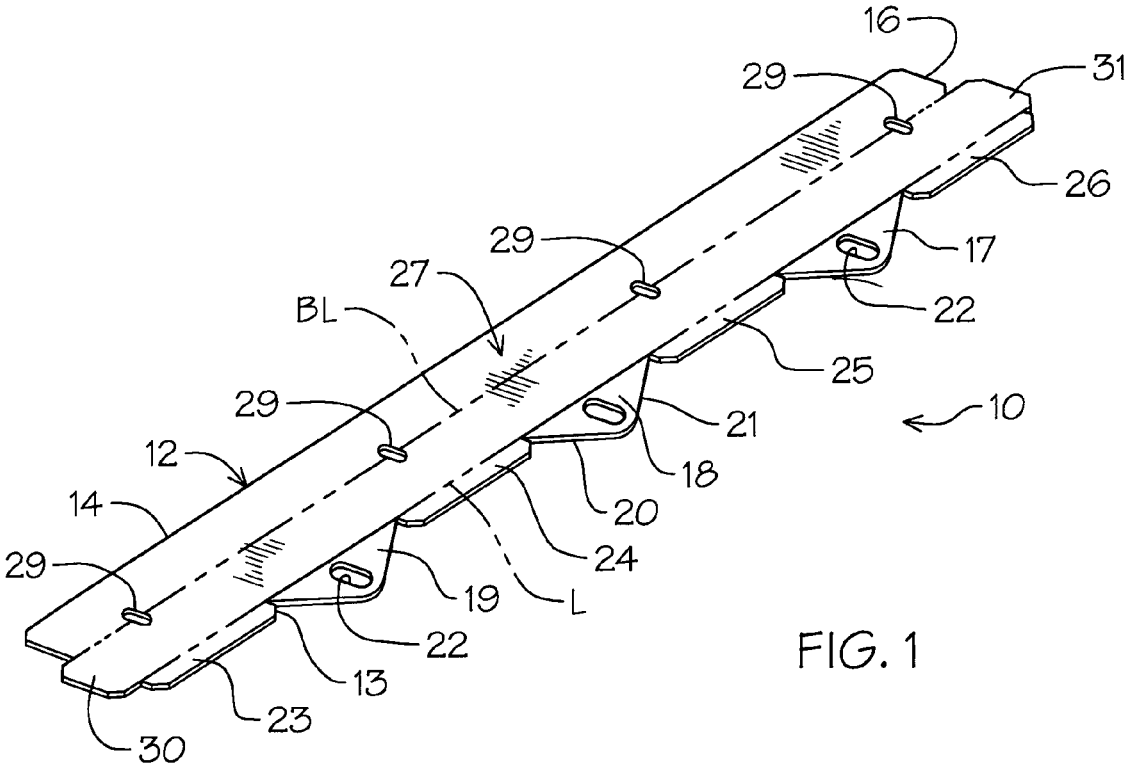
FIG. 1 is a perspective view of the sensor harness clamp of the invention.
Figure 2:
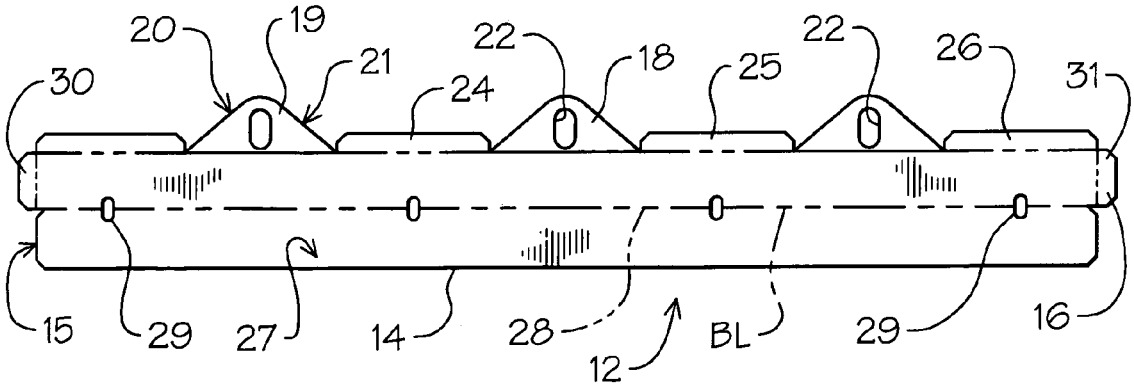
FIG. 2 is a bottom plan view thereof.

Referring to FIGS. 1 and 2 of the drawings, a sensor harness clamp 10 of the invention to hold and protect thermocouple wire assemblies 11 used in continuous steel casting operations can be seen. The harness clamp 10 has a thin flat elongated rectangular shaped main body member 12 preferably formed from thin gauge metal material. The body member 12 has spaced parallel side edges 13 and 14 interconnected by oppositely disposed end edges 15 and 16. A plurality of clamp mounting tabs 17-19 extend from and along the side edge 13 in longitudinally spaced orientation being spaced inwardly from the end edges 15 and 16 respectively.

Each of the mounting tabs 17-19 has opposing angularly disposed side edges 20 and 21 with a mounting slot 22 centrally positioned therewithin. Multiple retainment flanges 23-26 extend from the side edge 13 between said respective mounting tabs 17-19 each with a fold line indicated by broken lines at L indicating the definition of the retainment flanges as folded during the assembly as will be described in greater detail hereinafter.

The main body 12 has a corresponding "body" fold line indicated by broken lines BL that extends longitudinally the length thereof midway between the respective side edges 13 and 14 defining a wire restraint flange portion 27 which in turn as folded define a wire chase 28 therewithin.

A plurality of wire access openings 29 are formed within the main body member 12 in longitudinally spaced relation to one another along the body fold line BL in transverse central alignment with the hereinbefore described retainment flanges 23-26 respectively as best seen in FIG. 2 of the drawings.

End retainment flanges 30 and 31 extend from the respective end edges 15 and 16 between the corresponding body and fold over tab lines BL and L for selective engagement depending on wire assembly 11 exit position.

Figure 3:
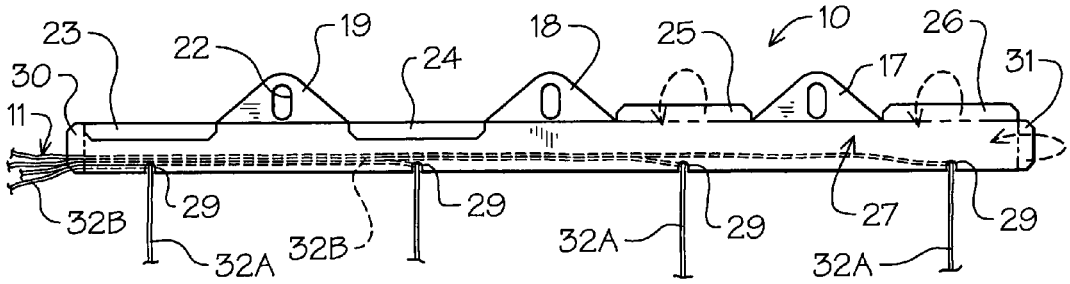
FIG. 3 is a top plan view of the sensor harness clamp engaged on multiple thermal couple wires and leads prior to mounting.

In use the main body member 12 is prefolded (generally) along its body fold line BL with the wire retainment flange portion 27 bent up and over the remaining body member portion being secured by the multiple retainment tabs 23-26 hereinbefore indicated by the broken bend arrows A in FIG. 1 of the drawings. Accordingly, multiple thermocouple sensor wires 32 of the wire assembly 11 are prepositioned within the so formed wire chase 28 and then individually passed through their corresponding wire access openings 29 thereby delineating a mold insertion wire portion 32A extending therefrom and a data transfer lead wire portion 32B on each of the wire sensors as best seen in FIGS. 3 and 4 of the drawings.

It will be evident to those skilled in the art that the relative length of the body member 12 and corresponding number of mounting tabs, retainment flanges and wire access openings can vary dependent on the sensor number needed in the application venue as will be determined by operational application and described in greater detail hereinafter.

Figure 4:
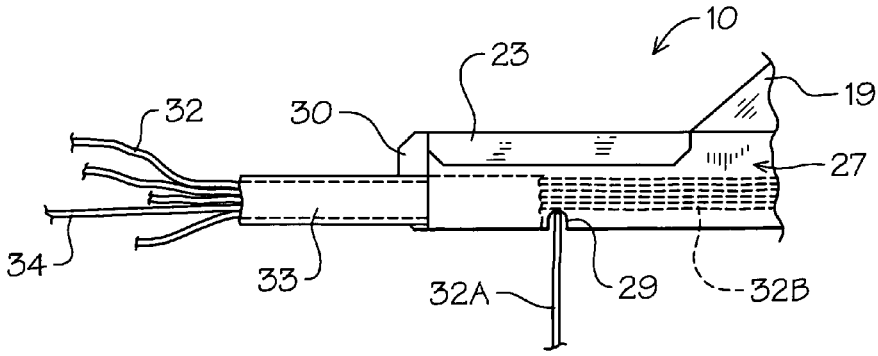
FIG. 4 is an enlarged broken away section thereof.

Referring now to FIG. 4 of the drawings, the harness clamp 10 of the invention is engaged with multiple sensor wires 32 extending through and outwardly thereof in which at the point of conjoined exit having a flexible cable tubing sheath 33 for protection thereon. In this application a stiffening wire 34 is slid into the cable tubing sheath 33 with the bundled sensor wires 32 positioned therewithin providing rigidity to the cable/wire assembly as it leaves the harness clamp 10 as hereinbefore described and best seen in FIG. 5 of the drawings.

The harness clamp 10 which is now closed around the multiple position sensor wires 32 by the inner engagement of the multiple retainment flanges 23-26 and the corresponding end flange 31 in this application are folded over the retainment flange portion 27. The so configured harness clamp 10 is then positioned on a continuous casting mold tube body 35 that extends from a top plate 36.

Figure 5:
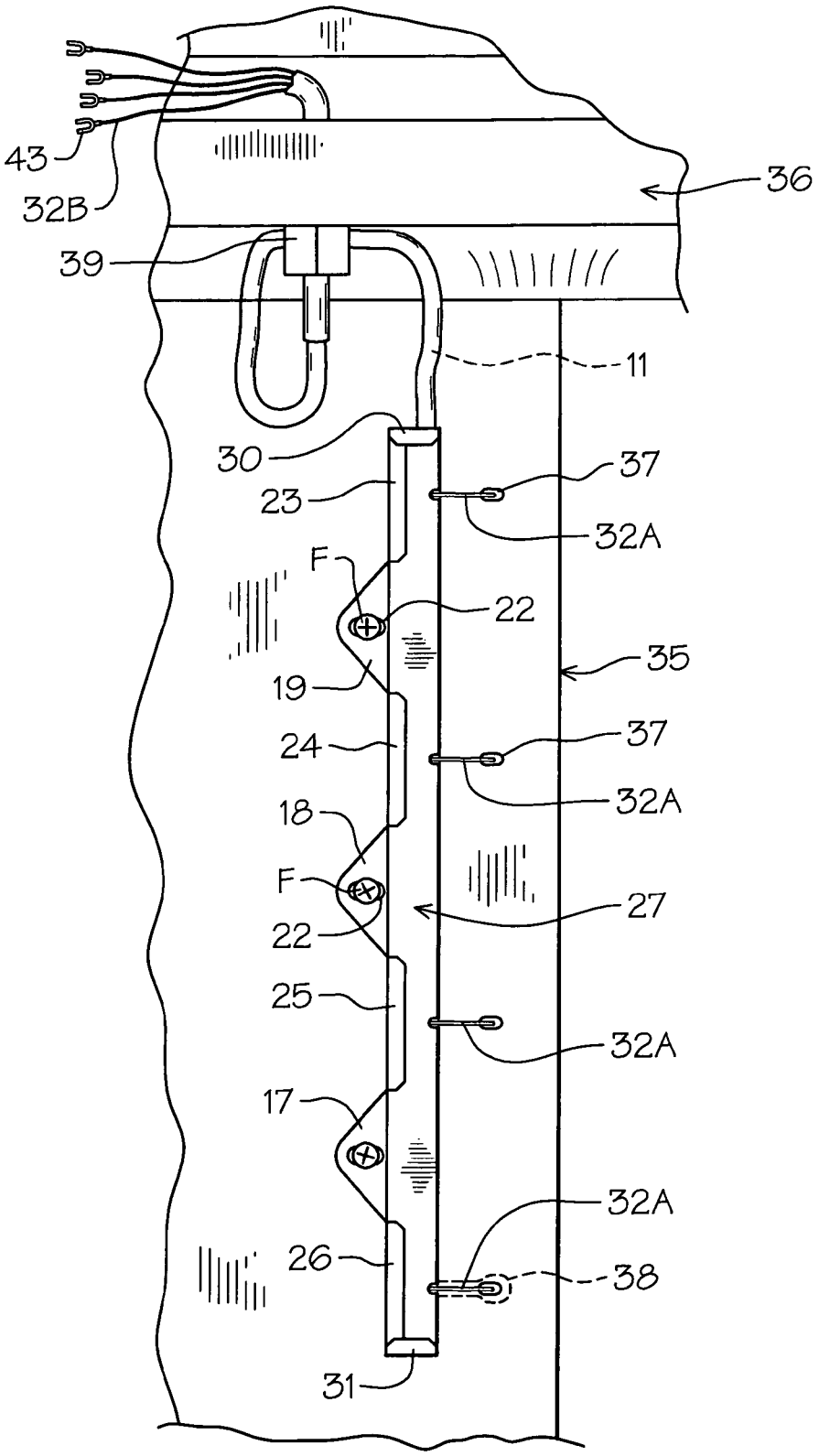
FIG. 5 is a partial front elevational view of the sensor holding clamp mounted on a mold tube.

The so designated mold insertion wire portions 32A of the respective sensor wires 32 extending from the harness clamp 10 are inserted into aligned mold apertures 37 in the mold tube body 35 as best seen in FIG. 5 of the drawings. The harness clamp 10 is then affixed as shown by fasteners F through the respective apertured mounting tabs 17 and 19 to the mold tube body 35.

Epoxy sealant indicated at 38 is in this application filled in and around the respective mold apertures 37 and their corresponding sensor wires 32A. Multiple sensor wires 32 data transfer lead portions 32B within the wire chase 28 in the stiffened cable tubing sheath 33 has a water-tight intermediate fitting 39 on the cable tubing sheath 33 which is at a distance to the assembled and secured wire harness 10 and is registerable in a support fixture 40 on the mold top plate 36 from which the mold tube body 35 extends.

Figure 6:
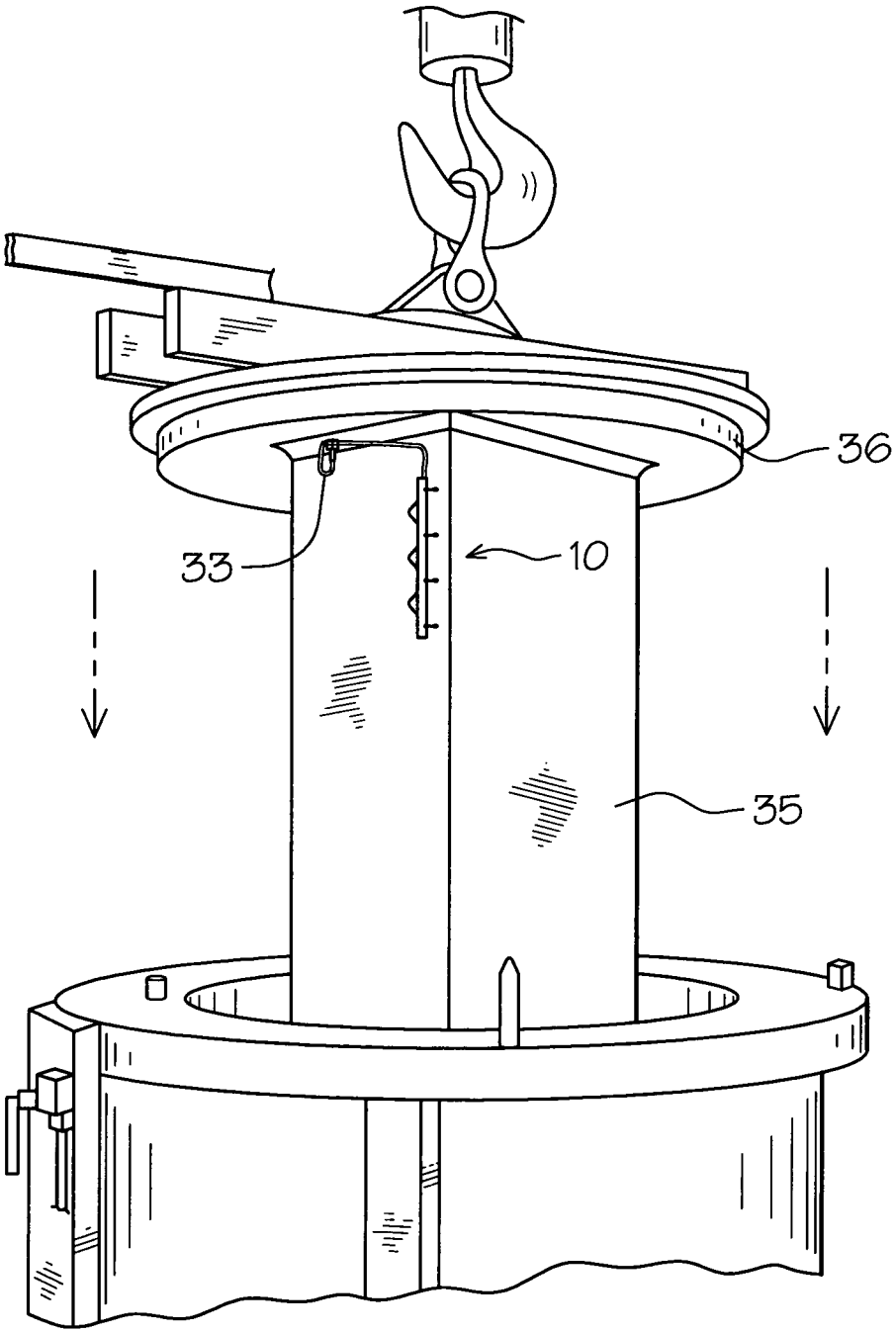
FIG. 6 is a graphic perspective illustration with portions broken away of the sensor holding clamp of the invention mounted on a mold tube being positioned for placement into a continuous casting cooling jacket.

A completed sensor installation at 41 allows for the positioning of the top plate 36 and mold tube body 35 into a water cooling housing 42 well known within the art as illustrated graphically in FIG. 6 of the drawings. The sensor wires 32 data transfer lead portions 32B each have a terminating spade lug 43 which afford attachment to a data field connector (not shown) well understood and known within the art to provide temperature sensor data for the system.

It will thus be seen that a new and novel sensor harness clamp for continuous casting mold tubes has been illustrated and described and that the sensor clamp provides a single use universal mounting and placement retainment device for multiple thermocouple wire sensors to be used without the need for prior art stainless steel clad sensors currently in use.

It will be apparent to those skilled in the art therefore that changes and modifications may be made therein without departing from the spirit of the invention.

Therefore I claim:

1. A temperature sensor harness positioning and mounting clamp in combination with mold tubes in continuous castors comprising, an elongated metal band having multiple sensor wire receiving openings in spaced longitudinal alignment to one another in a longitudinal center fold line in said band, a plurality of longitudinally spaced elongated retainment flanges and apertured mounting tabs extending alternately and integrally from one edge of said band, said retainment flanges registerable over an oppositely disposed edge-portions of said band when folded thereover in transverse aligned spaced relation to said sensor wire receiving openings therein, a sensor wire receiving chase formed by a wire restraint portion of said band overlying a remaining elongated parallel portion of said band, said sensor wire receiving chase extends from said center fold line in said band to said retainment flanges, sensor wires extending through said respective wire receiving openings, and mold insertion portions of said sensor wires extending into aligned mold apertures in said mold tubes.

2. The temperature sensing harness positioning and mounting clamp combination set forth in claim 1 wherein said elongated metal band is of thin flat deformable heat transferable metal material.

3. The temperature sensing harness positioning and mounting clamp combination set forth in claim 1 wherein securing said sensor harness clamp to said mold tube comprises, a plurality of fasteners extending through said apertures in said mounting tabs.

4. The temperature sensor harness positioning and mounting clamp combination set forth in claim 1 wherein said sensor wires have data transfer lead portions and a cable tubing sheath around said data transfer lead wire portions within said wire receiving chase.

5. The temperature sensor harness positioning and mounting clamp combination set forth in claim 1 wherein said mold tubes comprises, a mold tube body with said aligned mold apertures therein, a mold top plate and a water cooling housing.

* * * * *